United States Patent [19]

Hemingway et al.

[11] 4,430,041

[45] Feb. 7, 1984

[54] CRANE AND MANIPULATOR INTEGRATION

[75] Inventors: Trevor Hemingway, Dronfield; Anthony E. Middleton, Swinton, both of England

[73] Assignee: Davy-Loewy Limited, Sheffield, England

[21] Appl. No.: 310,728

[22] Filed: Oct. 13, 1981

Related U.S. Application Data

[63] Continuation-in-part of Ser. No. 181,660, Aug. 26, 1980, abandoned, which is a continuation of Ser. No. 941,404, Sep. 11, 1978, abandoned.

[30] Foreign Application Priority Data

Sep. 15, 1977 [GB] United Kingdom ..... 38614/77

[51] Int. Cl.[3] ..... B21J 13/10

[52] U.S. Cl. ..... 414/787; 72/420; 212/159; 414/152; 414/561

[58] Field of Search ..... 100/45, 215; 72/419, 72/420; 414/152, 186, 560, 561, 787; 212/159, 160, 164

[56] References Cited

U.S. PATENT DOCUMENTS

| | | | |
|---|---|---|---|
| 1,308,593 | 7/1919 | Kendall | 72/420 |
| 1,876,290 | 9/1932 | Hanna | 414/911 |
| 3,543,952 | 12/1970 | Young | 414/274 |
| 4,076,130 | 2/1978 | Sumner | 414/747 |

FOREIGN PATENT DOCUMENTS

| | | | |
|---|---|---|---|
| 2839903 | 3/1979 | Fed. Rep. of Germany | 72/420 |
| 127371 | 8/1959 | U.S.S.R. | 212/18 |

*Primary Examiner*—Sherman D. Basinger

*Attorney, Agent, or Firm*—Schwartz & Weinrieb

[57] ABSTRACT

An installation for handling a workpiece, particularly a workpiece to be forged includes a manipulator and an overhead crane, the controls of the manipulator and the crane form part of an integrated system so that movement of the crane and the manipulator are controlled together when they are handling a workpiece. Apparatus is disclosed for ensuring that the crane and the manipulator remain in step.

6 Claims, 6 Drawing Figures

CRANE AND MANIPULATOR INTEGRATION

CROSS-REFERENCE TO RELATED APPLICATIONS

This application is a continuation-in-part of the U.S. patent application Ser. No. 181,660 filed Aug. 26, 1980, now abandoned, which in turn is a continuation application of application Ser. No. 941,404 filed on Sept. 11, 1978, now abandoned.

FIELD OF THE INVENTION

This invention relates to installations for handling workpieces and in particular to installations for handling workpieces during forging.

BACKGROUND OF THE INVENTION

Installations for handling a workpiece to be forged may include one or more manipulators by which the workpiece to be forged is supported. It is known, in the interest of efficiency, for the operation of the forging press and that of the, or each, manipulator to be integrated so that the press and the or each manipulator work together. In such an integrated system the operation of the press and the or each manipulator may be controlled by a single operator from a control desk.

In some installations it is sometimes necessary to support a workpiece with one or more manipulators and with one or more overhead cranes.

SUMMARY OF INVENTION

According to a first aspect of the present invention an installation comprises:

an overhead crane movable along a first path, electrical drive means for moving the crane along the path, a manually operable control device for producing an electrical control signal, control means for controlling the drive means in response to said control signal to bring about desired movement of the crane along the first path, a manipulator movable along a second path which is parallel to and beneath the first path, and having a peel for supporting an elongate workpiece in cantilever fashion, drive means for moving the manipulator along the second path, a manually operable control device for producing an electrical control signal, control means for controlling the drive means in response to said control signal to bring about desired movement of the manipulator along the second path, and means arranged to receive either or both of said control signals and to produce a further control signal which is applied to both of said control means whereby the drive means of the crane and the drive means of the manipulator are controlled together.

In such an installation it is possible for the operator either to control the movement of the crane and the manipulator together by means of one manually operable control device or to move the crane and the manipulator independently each in response to its own manually operable control device.

Normally the means arranged to receive either or both of said control signals would in fact only receive one control signal since only one of the manually operable control devices is in use. The means thus applies the one control signal which it receives to the control means of both the crane and the manipulator whereby the drive means of the crane and the drive means of the manipulator are controlled together. If the means receives signals simultaneously from both of the manually operable control devices then the means is arranged to take either the highest or the average of the two signals and supply it to the control means of both the manipulator and the crane.

According to a second aspect of the invention an installation comprises:

two overhead cranes movable along a first path and each having:

electrical drive means for moving the crane along the path, a manually operable control device for producing an electrical control signal, control means for controlling the drive means in response to said control signal to bring about desired movement of the crane along the first path, two manipulators movable along a second path which is parallel to and beneath the first path and each manipulator having a peel for supporting an elongate workpiece in cantilever fashion, drive means for moving the manipulator along the second path, a manually operable control device for producing an electrical control signal, control means for controlling the drive means in response to said control signal to bring about desired movement of the manipulator along the second path, and switch means by which control signals from any two or more of the manually operable control devices are applied to means which produces a further control signal therefrom and applies said further signal to the control means corresponding to each of the selected manually operable control devices.

In such an installation an operator can control each crane and each manipulator independently by way of its own manually operable control device. In addition, by operating the switch means corresponding to two or more of the manually operable control devices, a control signal produced by any one of those control devices is applied to the control means of each of the drive means corresponding to the selected control devices. Normally a control signal is received from only one of the control devices at any time and thus this control signal is applied simultaneously to the control means of the selected crane(s) and manipulator(s).

In addition to moving the or each crane and the or each manipulator under manual control it is desirable that at least one crane and at least one manipulator should operate automatically when supporting a workpiece being forged a forging press. A signal is generated which is dependent on the required longitudinal traverse of the workpiece between successive forging strokes and this signal is supplied to the control means of the manipulator. The manipulator thus moves with a regular, but possibly intermittent, motion along the path. At the same time a signal is generated dependent upon the required speed of operation of the press and the stroke thereof and this signal is applied to the control means of the crane. If these two signals have been selected correctly then the crane and the manipulator will move together and keep in step. If, as is more likely, these two signals have not been correctly selected, the crane will not remain in step with the manipulator and one will move at a different speed relative to the other. The workpiece is supported from the crane by a burden chain or cable and if the workpiece and manipulator become out of step then this chain or cable will no longer be vertical. Means are provided for producing an electrical signal which is representative of the angle of the suspension cable or chain with respect to the vertical and the signal is supplied to the control means of the crane to adjust the movement of the crane in the sense to reduce said angle substantially to zero. The signal is conveniently provided by a transducer mounted on the crane and arranged to determine the angle of displacement of the pulley block of the crane from the vertical and also whether the pulley block is ahead or behind the vertical axis.

In an integrated installation where a workpiece is supported by a manipulator together with an overhead crane, rotation of the workpiece may be brought about by rotating the peel of the manipulator, in which case the burden chain supporting the workpiece from the crane is free running so that the workpiece is free to rotate under control of the manipulator. Alternatively for operations which require the manipulator and the crane to provide torque to rotate the workpiece, manipulator instrumentation may be used for measuring and controlling the rotational movement of the workpiece. Equalisation of drive speeds will be achieved if the two drives are of the constant torque type.

BRIEF DESCRIPTION OF THE DRAWINGS

In order that the invention may be more readily understood it will now be described, by way of example only, with reference to the accompanying drawings in which.

DETAILED DESCRIPTION OF THE ILLUSTRATED EMBODIMENTS

Figure 1:
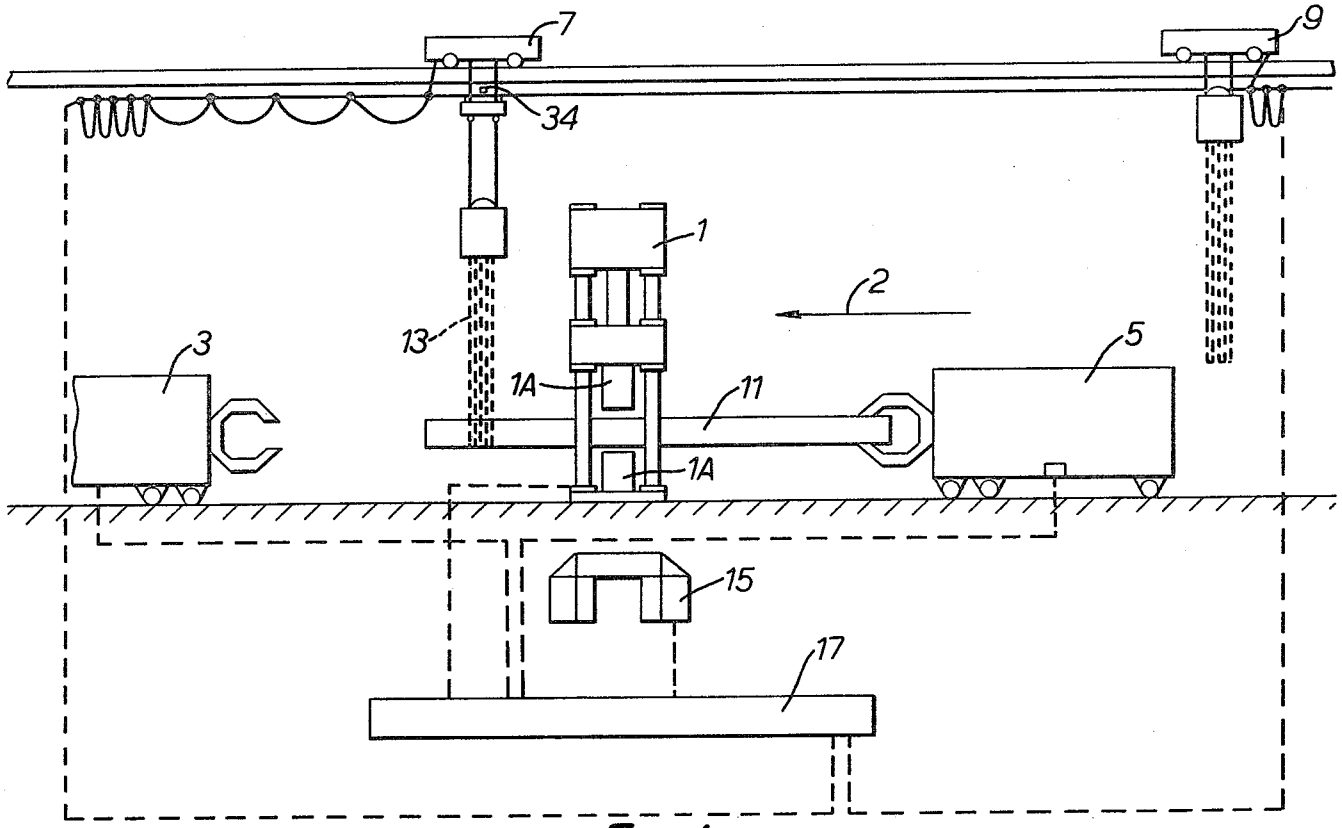
FIG. 1 shows diagrammatically a forging installation in which a workpiece can be supported by one or two manipulators and one or two overhead cranes.

Referring to FIG. 1, an integrated forging installation comprises a forging press 1 with forging tools 1A and with a pair of manipulators 3, 5 positioned one on each of the opposite sides of the forging press in the direction of forging indicated by arrow 2. The manipulators are preferably of the rail bound type.

A pair of cranes 7, 9 are mounted on an overhead gantry above the forging press and arranged one on each of the opposite sides of the forging press in the direction of forging. The cranes and the manipulators can each provide a support for a metal workpiece 11 to be forged and the combination of supports which are used may be changed during the forging cycle. For example, the workpiece may initially be supported by the manipulator alone and as the length of the workpiece extends during the forging cycle the end of the workpiece which is passed through the press may be supported by the overhead crane 7 on a burden chain 13. Eventually the overhead crane 7 may be replaced or assisted by the manipulator 3. In the case of an extremely heavy workpiece it could be supported on one side of the press by the crane 9 and the manipulator 5 and on the opposite side of the press by the crane 7 and the manipulator 3. The entire installation is controlled by an operator at a control desk 15. A cubicle 17 which may form part of the control desk 15 or be positioned close to it, contains electrical equipment by which signals can be sent from the cubicle 15 to each of the cranes 7, 9 and each of the manipulators 3, 5. Furthermore signals can be passed along a link between the press 1 and the equipment in the cubicle 17.

Figure 2:
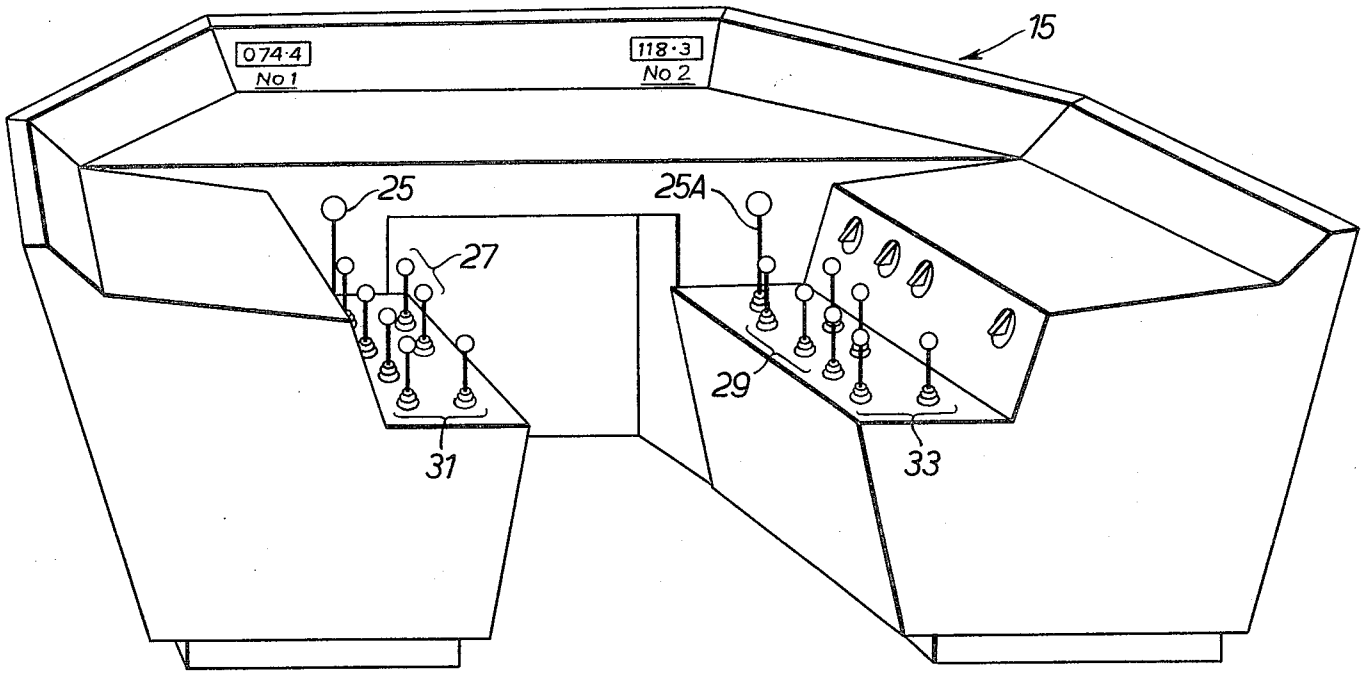
FIG. 2 is a perspective view of a control desk for integrated forging installations showing the controls for the press, crane(s) and manipulator(s)
Figure 3:
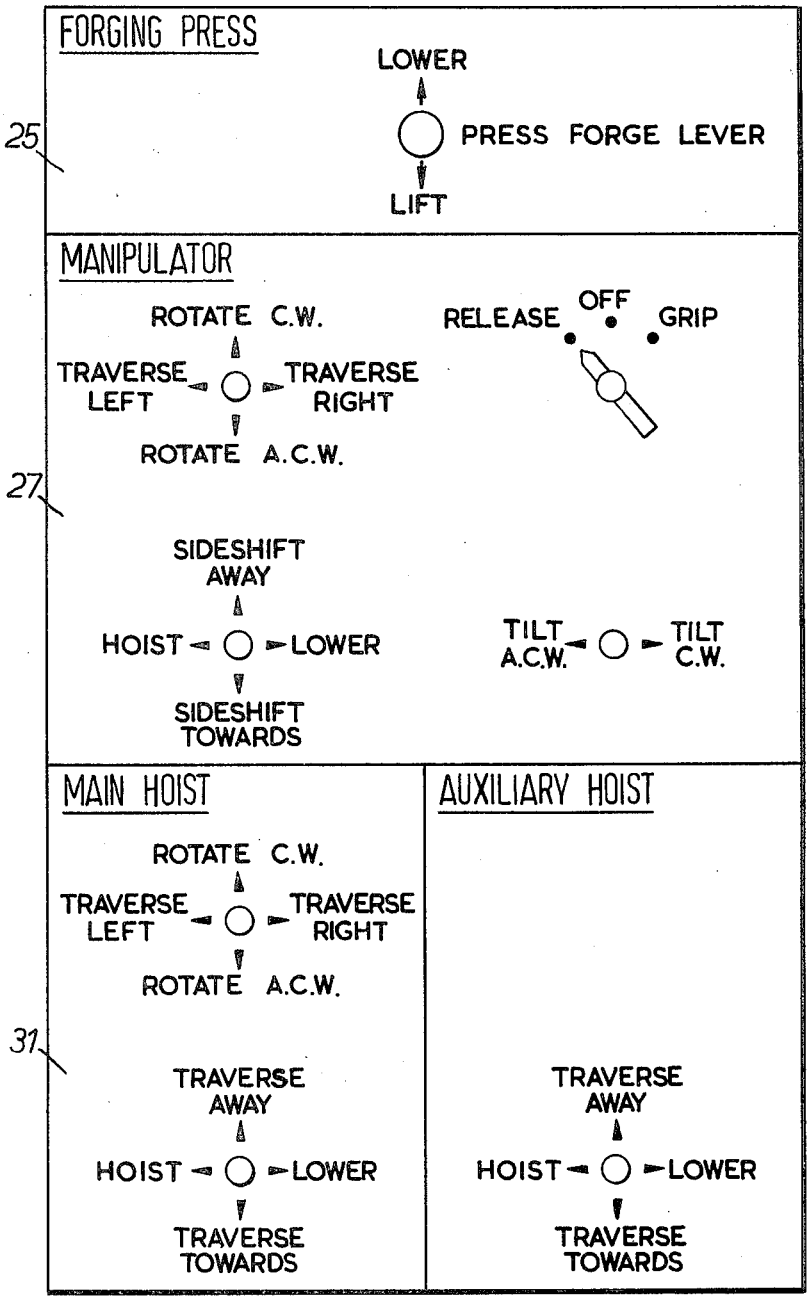
FIG. 3 is a possible layout of the principal controls of the press, a manipulator and a crane on the desk shown in FIG. 2.

Referring to FIGS. 2 and 3, the forging press is controlled by a manually operable device in the form of a joy-stick 25 which is duplicated at **25*a* on the control desk. The controls for manipulator 3 are arranged together as indicated by reference 27 on one part of the control desk while the controls for the second manipulator are indicated by reference 29 and are similarly grouped together on the other side of the desk. By means of the controls 27 and 29 each manipulator can be traversed to the left or to the right, the peel can be rotated either clockwise or anticlockwise, the peel may be raised or lowered, it may be shifted laterally and it may be titled up and down or slewed to the right or the left. The controls for crane 7 are grouped together as indicated by reference 31 and the controls for crane 9 are indicated by reference 33**. By means of these controls, the crane can be traversed forward and back in the direction of forging and the main and the auxiliary hoist, if provided, may be traversed normal to the direction of forging, the crane hook can be raised or lowered and the burden chain can be rotated in both directions of rotation.

The movement of the crane(s) in the direction of forging is controlled manually by one of the joy-sticks 31, 33. These joy-sticks provide an electric signal which is representative of the position of the joy-stick from its central off position.

Clearly when at least one manipulator and at least one crane are being used to support a workpiece it is fairly difficult for an operator to control the two joy-sticks together to provide operating signals to the drive for the crane and for the manipulator. It is even more difficult when two cranes and two manipulators are being used to support a workpiece and it is necessary to operate four joy-sticks simultaneously in order to bring about simultaneous movement of the four machines.

Figure 5:
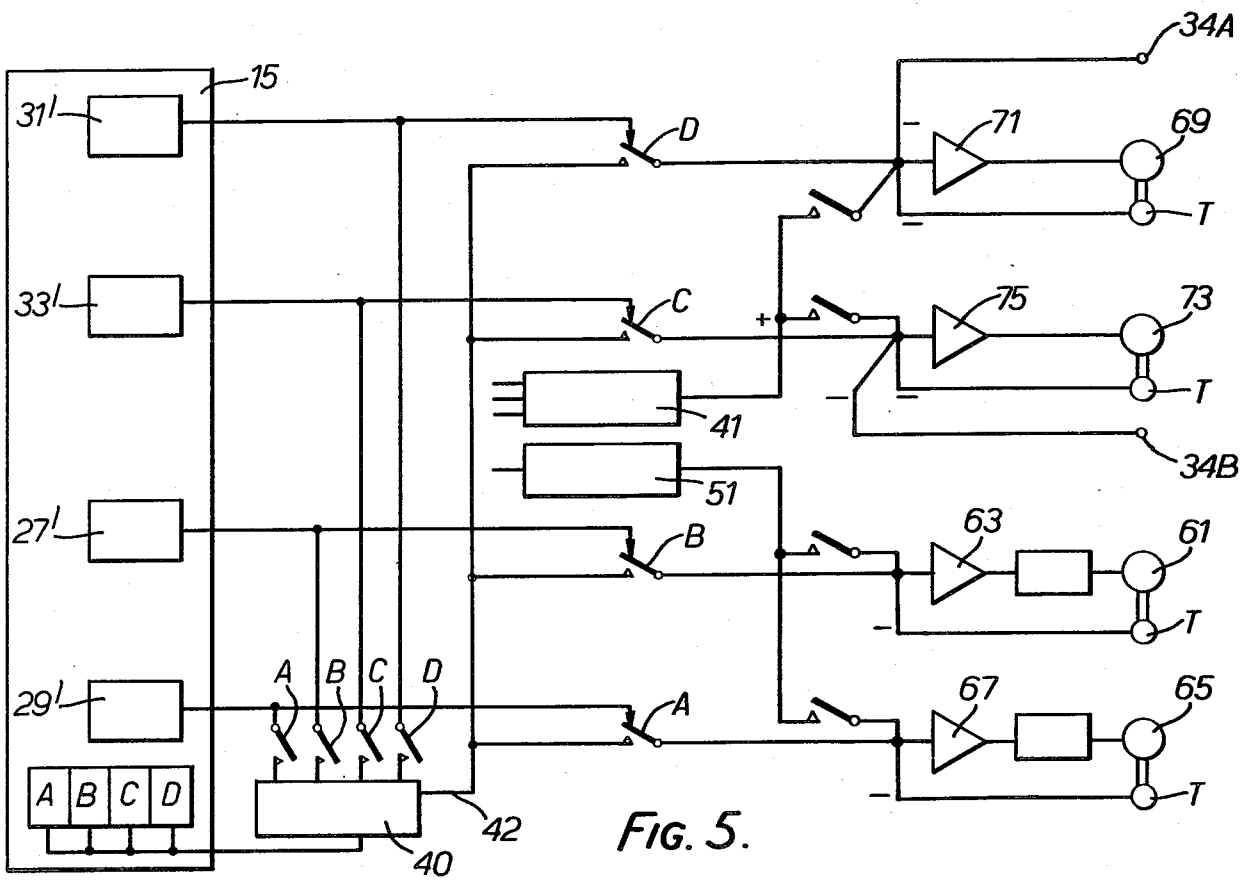
FIG. 5 shows diagrammatically how the operation of up to two cranes and two manipulators can be combined together.

Referring to FIG. 5, control desk 15 is shown having joy-sticks 31', 33', 27', and 29' which serve as manually operable control devices for producing an electrical control signal for controlling the traverse movement of cranes 7, 9 and manipulators 3, 5 respectively. The traverse movement of crane 7 in the direction of forging is brought about by an electric motor 69 and similarly the traverse movement of the crane 9 is brought about by an electric motor 73. The movement of the manipulator 3 is brought about by a hydraulic motor 61 and similarly the movement of the manipulator 5 in the direction of forging is brought about by a hydraulic motor 65. Each of these motors is fed through an amplifier 71, 75, 63 and 67 respectively. Each of the motors has a tachometer T coupled to it to provide negative feedback to the corresponding amplifier.

The output from each of the joy-sticks is supplied to the amplifier of its corresponding motor through a two pole switch A, B, C and D respectively. The output is also connected through a normally open switch contact A-D to a device 40 which provides an output on line 42. Line 42 is connected to the second pole of each of the switches A, B, C & D. On the control desk 15 there are four pushbuttons labelled A, B, C & D respectively. On operating one of these pushbuttons, the appropriate switch contact leading to the input of circuit 40 is closed so that the control signal from the appropriate joy-stick is supplied to the circuit 40. At the same time the appropriate switch is moved to its second operating position so as to connect the line 42 to the amplifier of the control circuit. Thus if all the pushbuttons A, B, C and D are operated, then the output from each of the joy-sticks is supplied to the circuit 40 and the line 42 is connected to each of the amplifiers. The circuit 40 consists basically of an input resistor and a diode for each of the inputs, the diodes being commoned and connected to line 42 through an amplifier. In this way a signal on any of the input lines is supplied to the output 42 and if signals are received simultaneously on two or more of the inputs then the circuit is arranged to take the largest of these inputs. Alternatively the circuitry can be adjusted to produce an average signal on the line 42 as opposed to the largest signal. Thus if all of the switches A-D are operated, the operator can employ one of the joy-sticks, say joy-stick 31' to provide an input signal to the circuit 40 which provides a signal on line 42 which is applied to the amplifier of each of the motors. Thus the four motors are controlled by the one joy-stick. It is not necessary to select a particular joy-stick from which to control a number of combined machines. Any of the joy-sticks appropriate to that function will be equally available, it being left to the operator to select the most convenient joy-stick.

Figure 4:
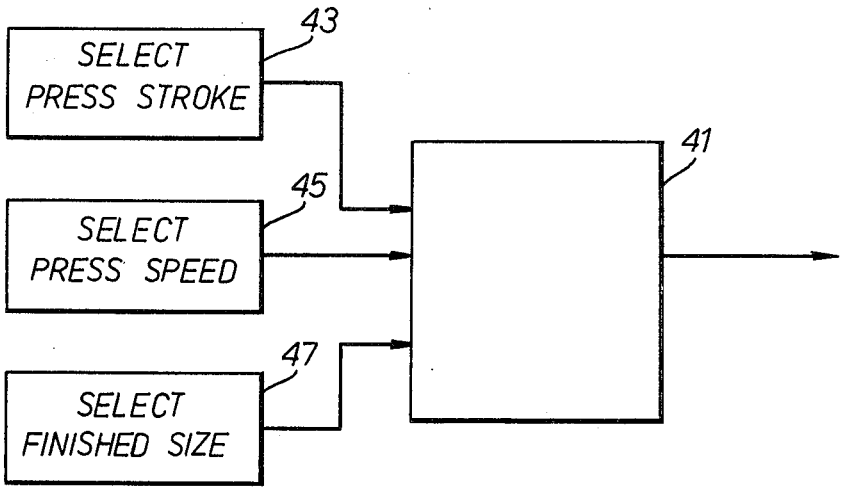
FIG. 4 is a diagrammatic circuit arrangement for generating crane traverse speed signals.

Referring now to FIG. 4, an arithmetic unit 41 is arranged to receive signals which correspond to the selected press stroke, the selected press speed, and the selected finished size from selectors 43, 45, and 47 respectively positioned on the control desk.

From the data supplied to it, the arithmetic unit determines an approximate required crane traverse speed and this is supplied through a normally open contact to an input of each of the amplifiers 71, 75. A signal representative of the selected longitudinal traverse distance to be moved by the workpiece between forging strokes is supplied from a selector on the control desk to circuit 51 which in turn supplies this signal through normally open contacts to the input of each of the amplifiers 63, 67. From the data supplied to it, the arithmetic unit 41 determines an approximate required crane traverse speed and similarly the unit 51 determines a speed of movement for the two manipulators. A transducer 34A, 34B is associated with each crane and if the crane hoist ropes are displaced from the vertical then the transducer produces a signal which is proportional to the angle of displacement and whether the displacement is a leading or trailing displacement. The output from each transducer 34A, 34B is fed back as a negative feedback signal to an input of the appropriate amplifier 71, 75.

When at least one crane and at least one manipulator are to be operated under automatic control then the output signal from the arithmetic unit 41 is supplied as an input to the amplifier controlling the crane motor of the or each crane and similarly the output of unit 51 is supplied as an input to the amplifier of the motor of the or each manipulator. As the crane and manipulator start to move simultaneously the workpiece will be supported by the or each crane and the or each manipulator and if the signals from the units 41 and 51 are incorrect so that the crane(s) and manipulator(s) do not remain synchronised, but one moves faster than the other, then a signal is produced by the appropriate transducer 34. This signal is fed back to the amplifier of the crane motor to modify the output of the amplifier in the sense to speed up or slow down the crane so that the supporting chains return to the vertical.

Where synchronisation of crane cross travel and manipulator side shift are required, a preset crane speed will be used which has previously been matched to the side shift rate of the manipulator. A control system is provided which causes the unloaded crane to always return to a position where the hook is on the centreline of the manipulator and press in the direction of forging.

For forging operations requiring a manipulator together with a crane which acts as additional support but does not provide turning force, the burden chain is free running. The workpiece is then free to rotate under the control manipulator. Step rotation and the integration of the press and manipulator may then be brought about.

Figure 6:
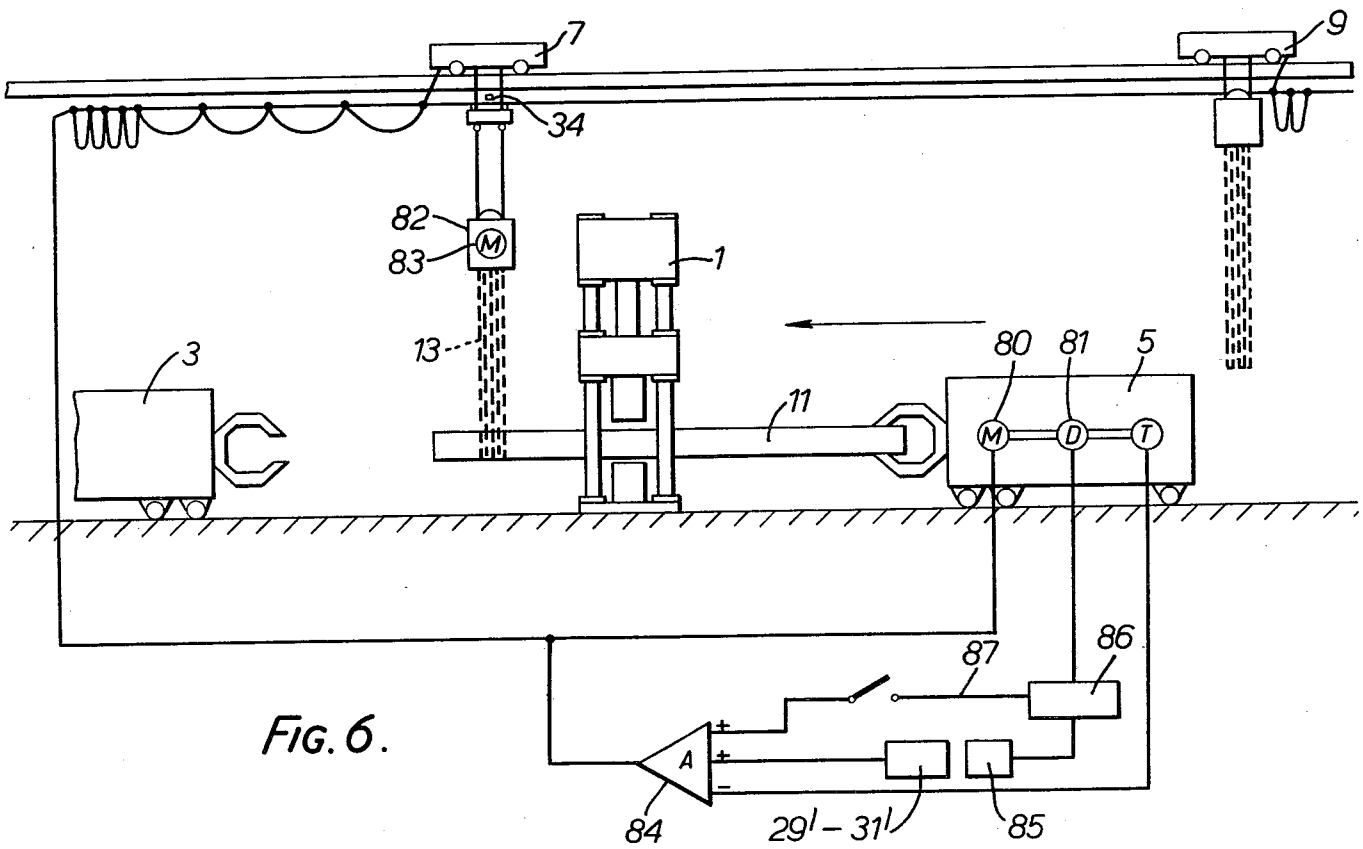
FIG. 6 shows diagrammatically how a workpiece supported by a manipulator and crane can be rotated.

For operations which require the manipulator and the crane to provide torque to rotate the workpiece, it is virtually impossible to accurately predict the crane motor speed since the drive between the burden chain and the workpiece is difficult to determine and may vary during the forging operation since the cross section of the workpiece where it is engaged by the burden chain is almost impossible to determine with accuracy. To this end the manipulator instrumentation is used for measuring angular position of the workpiece. Referring to FIG. 6, the manipulator 5 has a drive motor 80 for rotating the peel, a Digitiser 81 coupled to the motor and a Tachogenerator T also coupled to the motor. The Digitiser is a well known device which produces a digital signal proportional to its angle of rotation. The pulley block 82 of the crane 7 carries a motor 83 which serves to drive the burden chain 13 to rotate the workpiece supported by it. The motors 83 and 80 are controlled together in parallel from amplifier 84. The amplifier is connected to receive a control signal from one of the joy-sticks 29', 31' and a negative feedback signal from the tachgenerator T. A selector 85 on the control desk is employed when it is desired to autoamatically control the rotation of the workpiece. To this end the required angle of rotation is selected on the selector 85 and a corresponding signal is supplied to a comparator 86. The output of the Digitiser is also applied to the comparator and the two signals are compared in the comparator. Any error signal is supplied on line 87 and on connecting this line to the amplifier 84 the motors 83 and 80 are rotated, thereby rotating the workpiece, until the output from the Digitiser is equal to the angle selected on the selector 85. Equalisation of drive speeds will be achieved by means of the characteristics of the two drivers which will be of constant torque.

The transducers 34A, 34B which produce a signal representative of the displacement from the vertical of the crane suspension ropes may be of the type known as Linear Variable Displacement Transducers and sold by Elliot Automation Limited, Elstree Way, Borehamwood, Herts, England, and by Davy Instruments Limited, Darnall Works, Sheffield, England.

The tachometers T are readily available from Evershed & Vignoles Limited, Acton Way, London W4, England.

The Digitiser may be purchased from Ferranti Ltd., Manchester, England.

Obviously, many modifications and variations of the present invention are possible in light of the above teachings. It is therefore to be understood that within the scope of the appended claims, the present invention may be practiced otherwise than as specifically described herein.

We claim:

1. An installation, comprising:

an overhead crane movable along a first path;

electrical drive means for moving said crane along said first path;

manually operable control means for producing an electrical control signal;

control means for controlling said electrical drive means for said crane in response to said electrical control signal so as to bring about desired movement of said crane along said first path;

a manipulator movable along a second path which is parallel to and beneath said first path, and having a peel for supporting an elongate workpiece in a cantilever fashion;

drive means for moving said manipulator along said second path;

control means for controlling said drive means for said manipulator in response to said electrical control signal so as to bring about desired movement of said manipulator along said second path; and means arranged for receiving said control signal and for applying said control signal to both of said control means for said crane and said manipulator whereby said drive means of said crane and said manipulator are controlled together.

2. An installation as claimed in claim 1, comprising:

a second overhead crane movable along said first path;

electrical drive means for moving said second crane along said first path;

control means for controlling said drive means of said second crane in response to said control signal so as to bring about desired movement of said second crane along said first path; and means for permitting said control signal to be applied to said control means of said second crane.

3. An installation as claimed in claim 1, comprising:

a second manipulator movable along said second path and having a peel for supporting said elongate workpiece in a cantilever fashion;

drive means for moving said second manipulator along said second path;

control means for controlling said drive means of said second manipulator in response to said control signal so as to bring about desired movement of said second manipulator along said second path; and means for permitting said control signal to be applied to said control means of said second manipulator.

4. An installation, comprising:

two overhead cranes movable along a first path, and each having electrical drive means for moving said cranes along said first path;

manually operable control means for producing an electrical control signal;

control means for controlling said drive means of said cranes in response to said control signal so as to bring about desired movement of said cranes along said first path;

two manipulators movable along a second path which is parallel to and beneath said first path, and each manipulator having a peel for supporting an elongate workpiece in a cantilever fashion;

drive means for moving said manipulators along said second path;

control means for controlling said drive means of said manipulators in response to said control signal so as to bring about desired movement of said manipulators along said second path; and means for receiving said control signal from said manually operable control means and for selectively applying said control signal to said control means of said two cranes and said two manipulators.

5. An installation as claimed in claim 1 and including a forging press having a pair of forging tools and arranged such that a workpiece supported in cantilever fashion by the peel of said manipulator and by suspension means for said crane extends between the forging tools, means for generating a manipulator control signal dependent upon the required longitudinal traverse of the workpiece between forging operations and supplying the signal to the control means of the manipulator, means for generating a crane control signal dependent upon the required speed of operation of the press and the stroke thereof and supplying the signal to the control means of the crane, and means for producing an electrical signal representative of the angle of the suspension means with respect to the vertical, said signal being supplied to the control means of the crane to adjust the movement of the crane in the sense to reduce said angle substantially to zero.

6. An installation as claimed in claim 5 comprising drive means for rotating the peel of the manipulator, drive means for rotating said suspension means, means coupled to the peel to provide a signal proportional to the rotation of the peel, means for generating a signal proportional to the required rotation of the peel, and comparator means for comparing the signal proportional to the rotation of the peel and the signal proportional to the required rotation of the peel and for producing an output signal proportional to the difference between said signals, said difference signal being applied simultaneously to said drive means for rotating the peel and to said drive means for rotating the suspension means to rotate the workpiece in the sense to reduce said difference signal to zero.

* * * * *